US009085970B2

(12) United States Patent
Xiao et al.

(10) Patent No.: US 9,085,970 B2
(45) Date of Patent: Jul. 21, 2015

(54) THROUGH TUBING PUMPING SYSTEM WITH AUTOMATICALLY DEPLOYABLE AND RETRACTABLE SEAL

(71) Applicant: Saudi Arabian Oil Company, Dhahran (SA)

(72) Inventors: Jinjiang Xiao, Dhahran (SA); Abubaker Saeed, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 266 days.

(21) Appl. No.: 13/621,924

(22) Filed: Sep. 18, 2012

(65) Prior Publication Data

US 2013/0068311 A1 Mar. 21, 2013

Related U.S. Application Data

(60) Provisional application No. 61/536,778, filed on Sep. 20, 2011.

(30) Foreign Application Priority Data

Sep. 14, 2012 (WO) ..... PCT/US2012/05527

(51) Int. Cl.

| | |
|---|---|
| ***E21B 23/06*** | (2006.01) |
| ***E21B 33/128*** | (2006.01) |
| ***E21B 43/12*** | (2006.01) |
| ***F17D 3/00*** | (2006.01) |

(52) U.S. Cl.

CPC ..... *E21B 43/12* (2013.01); *E21B 23/06* (2013.01); *E21B 33/128* (2013.01); *F17D 3/00* (2013.01)

(58) Field of Classification Search

CPC .... E21B 23/06; E21B 33/128; E21B 33/1285
USPC ..... 166/387, 373, 106, 120, 131, 134, 184, 166/195

See application file for complete search history.

(56) References Cited

U.S. PATENT DOCUMENTS

| | | | | | |
|---|---|---|---|---|---|
| 1,000,583 | A | * | 8/1911 | Cooper | 166/151 |
| 1,698,444 | A | * | 1/1929 | Lybyer | 166/105.4 |
| 1,757,381 | A | * | 5/1930 | Oliver et al. | 417/108 |
| 1,916,875 | A | * | 7/1933 | Yarbrough | 166/311 |
| 2,103,940 | A | * | 12/1937 | Fletcher | 166/106 |
| 2,301,191 | A | * | 11/1942 | Boynton | 166/64 |

(Continued)

OTHER PUBLICATIONS

PCT International Search Report and the Written Opinion of the International Searching Authority dated Feb. 17, 2014; International Application No. PCT/US2012/055296; International File Date: Sep. 14, 2012.

*Primary Examiner* — Jennifer H Gay
(74) *Attorney, Agent, or Firm* — Bracewell & Giuliani LLP; Constance Gall Rhebergen; Keith R. Derrington

(57) ABSTRACT

A downhole pumping system in production tubing having a seal between the intake and discharge of a through tubing downhole pump that automatically deploys when the pump initiates operation. The seal automatically disengages when the pump suspends operating and redeploys when the pump starts operating again. The pumping system can be set at a different depth before restarting the pump. The seal can include a bladder like member that has an opening facing towards the pump discharge, so that discharged fluid expands the bladder radially outward into sealing contact with the tubing.

20 Claims, 3 Drawing Sheets

(56) References Cited

U.S. PATENT DOCUMENTS

| | | | | | |
|---|---|---|---|---|---|
| 2,345,710 | A | | 4/1944 | Lybyer | |
| 2,675,080 | A | | 4/1954 | Williams | |
| 3,066,739 | A | * | 12/1962 | Saurenman et al. | 166/141 |
| 3,170,520 | A | | 2/1965 | Arutunoff | |
| 3,186,489 | A | * | 6/1965 | Farrar et al. | 166/138 |
| 3,196,948 | A | * | 7/1965 | Dye | 166/66.4 |
| 3,411,454 | A | * | 11/1968 | Arutunoff | 417/423.3 |
| 3,891,031 | A | * | 6/1975 | Ortiz | 166/68.5 |
| 3,939,909 | A | * | 2/1976 | Ortiz | 166/68.5 |
| 4,246,964 | A | | 1/1981 | Brandell | |
| 4,928,771 | A | * | 5/1990 | Vandevier | 166/385 |
| 5,236,047 | A | | 8/1993 | Pringle et al. | |
| 5,297,943 | A | | 3/1994 | Martin | |
| 5,404,946 | A | | 4/1995 | Hess | |
| 5,667,015 | A | | 9/1997 | Harestad et al. | |
| 6,668,925 | B2 | | 12/2003 | Shaw et al. | |
| 6,915,845 | B2 | | 7/2005 | Leising et al. | |
| 7,059,410 | B2 | | 6/2006 | Bousche et al. | |
| 7,322,410 | B2 | | 1/2008 | Vinegar et al. | |
| 7,392,859 | B2 | | 7/2008 | Mock et al. | |
| 7,607,497 | B2 | | 10/2009 | Mock et al. | |
| 7,617,880 | B2 | | 11/2009 | Loughlin | |
| 7,621,322 | B2 | | 11/2009 | Arnold et al. | |
| 7,954,563 | B2 | | 6/2011 | Mock et al. | |
| 8,397,811 | B2 | * | 3/2013 | Reid | 166/265 |
| 8,689,892 | B2 | * | 4/2014 | Noui-Mehidi | 166/386 |
| 2004/0069504 | A1 | * | 4/2004 | Krueger et al. | 166/387 |
| 2005/0161232 | A1 | * | 7/2005 | Patel et al. | 166/386 |
| 2007/0114019 | A1 | | 5/2007 | Brezinski et al. | |
| 2009/0101362 | A1 | * | 4/2009 | Loughlin | 166/382 |
| 2010/0288493 | A1 | | 11/2010 | Fielder et al. | |
| 2010/0288501 | A1 | | 11/2010 | Fielder et al. | |
| 2011/0247831 | A1 | * | 10/2011 | Smith et al. | 166/372 |

* cited by examiner

THROUGH TUBING PUMPING SYSTEM WITH AUTOMATICALLY DEPLOYABLE AND RETRACTABLE SEAL

CROSS REFERENCE TO RELATED APPLICATIONS

This application claims priority to and the benefit of co-pending U.S. Provisional Application Ser. No. 61/536,778, filed Sep. 20, 2011, the full disclosure of which is hereby incorporated by reference herein.

BACKGROUND OF THE INVENTION

1. Field of the Invention

The present invention relates to a device for use in producing fluid from a wellbore. More specifically, the invention relates to a system and method for sealing an annular space between a pump and production tubing.

2. Description of the Related Art

Hydrocarbon producing wellbores extend subsurface and intersect subterranean formations where hydrocarbons are trapped. The wellbores are typically lined with casing and have production tubing inserted within the casing. Artificial lift is often relied on for producing hydrocarbons from within a formation when downhole pressure is insufficient for transporting produced liquids to the surface. Typically, artificial lift during oil and gas production uses pumping in the wellbore to lift fluids from downhole to surface and push them to processing facilities. Some pumping systems are integrated with production tubing and conveyed downhole with the production tubing. Other pumping systems are deployed downhole through already installed production tubing and suspended from coiled tubing or power cable.

Through tubing deployed pumping systems require isolation between pump intake and discharge, otherwise fluid exiting the pump can flow back downhole and enter the pump intake and be re-circulated through the pump. An example of an existing isolation technique presets a landing profile (e.g., seal bore) on the tubing. As the pumping system is installed, a seal assembly or seating shoe on the pumping system engages with the landing profile, thus sealing off the fluid path between pump intake and discharge.

It is not uncommon for the pump to be moved to a different depth during the life of the well to compensate for changes in reservoir pressure, water cut or productivity changes and optimize system performance. Changing pump setting depth though requires a workover rig to pull out the tubing and re-install the landing profile at a different depth.

SUMMARY OF THE INVENTION

Disclosed herein is an example of a downhole assembly for use in production tubing. In one embodiment the downhole assembly has a pump with a pump inlet and a pump discharge, a motor for driving the pump, and a seal between the pump inlet and pump discharge. In this example the seal is made up of a membrane like member shaped to define an opening facing the pump discharge. When fluid flows from the pump discharge, the discharged fluid enters the opening and urges a portion of the membrane adjacent the opening radially outward so that the membrane fills an annular space between the outer surface of the downhole assembly and production tubing and blocks discharged fluid from entering the pump inlet. Optionally, a lower end of the member distal from the pump discharge is clamped around the outer surface; in this example the member has a stowed position where it is disposed proximate an outer surface of the outer surface. The member is moveable to a deployed position having a cup like shape, wherein an upper end of the member proximate the pump discharge flares radially outward into contact with the tubing. In one alternative, a lower end of the member distal from the pump discharge is clamped around the outer surface and an upper end of the member proximate the pump discharge is secured to the outer surface so that a gap is between the upper end and the outer surface that defines the opening. In this alternate example, a middle portion of the member flares radially outward into contact with the tubing when discharge fluid flows into the opening. An anchoring system may optionally be included with the downhole assembly, where the anchoring system mounts onto an outer surface of the assembly and includes a plurality of anchoring legs. In this example, a portion of each anchoring leg selectively projects radially outward into contact with an inner surface of the tubing. An actuator is optionally mounted on the outer surface that selectively biases against ends of the anchoring legs for projecting the anchoring legs radially outward. In one example, the membrane like member is made up of an annular bladder. In an alternate embodiment, the seal includes a lower bracket that sealingly couples around the outer surface and an upper bracket that circumscribes the outer surface and is set radially outward from the outer surface. Yet further optionally, an upper end of the bladder mounts to the upper bracket and a lower end of the bladder mounts to the lower bracket. In one optional example, the membrane like member has a lower end that pivotingly mounts to the outer surface and an upper end with an outer periphery that defines the opening. Also, folds may be included in the membrane between the lower end and upper end. This embodiment may optionally include rib supports that extend along a path between lower and upper ends of the membrane and coupled with the membrane. Struts may also be included, where each strut has an end pivotingly mounted to an upper bracket that circumscribes the outer surface and a distal end pivotingly coupled to a one of the rib supports.

Also described herein is a wellbore assembly insertable in a tubular disposed in a wellbore. In one example the wellbore assembly includes a pump having a discharge and an annular inlet that depends axially from an end of the pump. A seal assembly is included that circumscribes the annular inlet and that includes; a lower bracket sealingly mounted to an outer surface of the annular inlet, a membrane having a lower end coupled to the lower bracket and an outer periphery that selectively projects radially outward into sealing contact with an inner surface of the tubular. The membrane is radially extended in response to a fluid flowing from the discharge and into a space between the membrane and the annular inlet. The wellbore assembly can further include an upper bracket that circumscribes the annular inlet an axial distance from the lower bracket. In this example an upper end of the membrane is coupled to the upper bracket. In one example, the upper bracket is spaced radially outward from the annular inlet. In one alternate embodiment, the wellbore assembly further includes an anchoring system made up of elongated linkage members disposed at circumferential positions around the annular inlet, upper ends mounted in an upper collar, and lower ends mounted in a lower collar. In this example, an actuator is included for selectively biasing the upper collar towards the lower collar and causing the mid portions of the linkage members to extend radially outward from the annular inlet and into engagement with an inner surface of the tubular. In an example embodiment, the membrane has an elliptical shape when the outer periphery projects radially outward. Optionally, the membrane like member has a lower end that pivotingly mounts to an outer surface of the annular inlet and an upper end with an outer periphery that defines an opening, folds may be included in the membrane that are between the lower end and upper end. Also optionally in the membrane are rib supports extending along a path between lower and upper ends of the membrane and coupled with the membrane. Alternatively, struts may be included that each have an end pivotingly mounted to an upper bracket that circumscribes the outer surface and a distal end pivotingly coupled to a one of the rib supports.

A method of pumping fluid from a wellbore is also disclosed herein. In one example the method includes providing a wellbore assembly that includes a pump having an inlet and a discharge, and a seal assembly. In this example the seal assembly has a toroidally shaped membrane with a lower end sealed against an outer surface of the wellbore assembly and an upper end spaced radially outward from the outer surface to define an opening. The method of this embodiment further includes disposing the wellbore assembly in a tubular in the wellbore and forming a seal between the wellbore assembly and the tubular. The seal is formed by using the pump to pressurize fluid produced from the wellbore, and flowing the pressurized fluid from the discharge to the opening to radially expand the membrane into sealing engagement with the tubular. The method can also include suspending pump operation so the membrane radially retracts from the tubular, moving the wellbore assembly to a different depth in the wellbore, and reforming the seal at the different depth. In one example, the seal isolates fluid produced from the wellbore from fluid being discharged from the pump.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

Figure 1A:
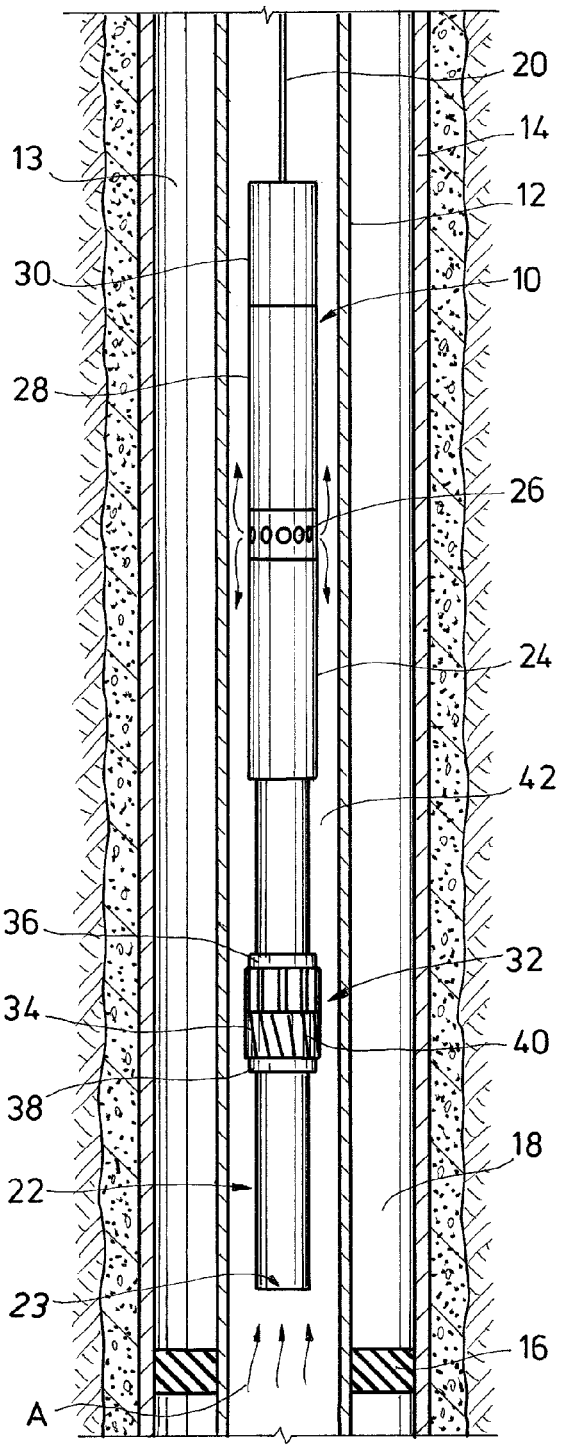
FIG. 1A is a side partial sectional view of an example embodiment of a through tubing pumping system having a seal in a stowed position and in accordance with the present invention.

Shown in FIG. 1A is a side partial sectional view of an example of an electrical submersible pumping (ESP) system 10 disposed within a length of production tubing 12. In an example embodiment, the ESP system 10 is used for pumping fluids from within a wellbore 13 shown lined with casing 14. An optional packer 16 is illustrated set in the annular space 18 between the tubing 12 and casing 14, where the packer 16 forms a flow barrier in the annular space 18. The ESP system 10 of FIG. 1A is suspended within the tubing 12 on a lower end of a power cable 20. Electricity for powering the ESP system 10 can be delivered through the power cable 20. Optionally, the power cable 20 can also deliver control signals from a controller (not shown) to the ESP system 10. An annular pump inlet 22 having an opening 23 on its lowermost end is shown depending downward from a lower end of a pump 24. In an example, fluids produced from the wellbore 13 are directed to the pump 24 through the pump inlet 22. Above the pump 24 are a series of ports 26 that define a pump exit through which fluid discharges after being pressurized in the pump 24. A pressure compensating seal 28 is included shown disposed above the ports 26 and having on its upper end a motor 30 for driving the pump 24. In one example, a pump shaft (not shown) connects the motor 30 to the pump 24.

An isolation device 32 is shown circumscribing a portion of the annular pump inlet 22. In the embodiment of FIG. 1A, the isolation device 32 includes a membrane like barrier 34 set between an upper bracket 36 and lower bracket 38. The barrier 34 as shown in the example of FIG. 1A, is in a stowed position and set proximate to an outer surface of the pump inlet 22. Optionally, the isolation device 32 can be set on other portions of the ESP system 10. Other embodiments have the isolation device 32 anywhere between the opening 23 on the inlet 22 and ports 26.

Still referring to FIG. 1A, the lower end of the barrier 34 is affixed around the pump inlet 22 by the lower bracket 38. The upper end of the barrier 34 however can freely move in a direction radially outward from the outer surface of the inlet 22. As will be discussed in more detail below, the barrier 34 has an outer circumference that increases with distance away from the lower bracket 38 and towards the upper end of the barrier 34. To allow the increasing diameter of the barrier 34 to be in the stowed position of FIG. 1A, a series of folds 40 are shown optionally formed in the barrier 34.

Arrows A representing fluid produced from within the wellbore 13 are shown within the tubing 12 and directed towards the opening 23 in the inlet 22. In the configuration of FIG. 1A, the produced fluid can flow unimpeded within the annulus 42 defined between the ESP 10 and inner surface of the tubing 12. Activation of the motor 30 to drive the pump pressurizes the portion of the produced fluid drawn into the inlet 22 and discharges the pressurized fluid (represented by arrows exiting the ports 26) into the annulus 42. Because the discharged fluid has a pressure greater than the produced fluid, at least some of the discharge fluid will flow downward within the annulus and towards the isolation device 32.

Figure 1B:
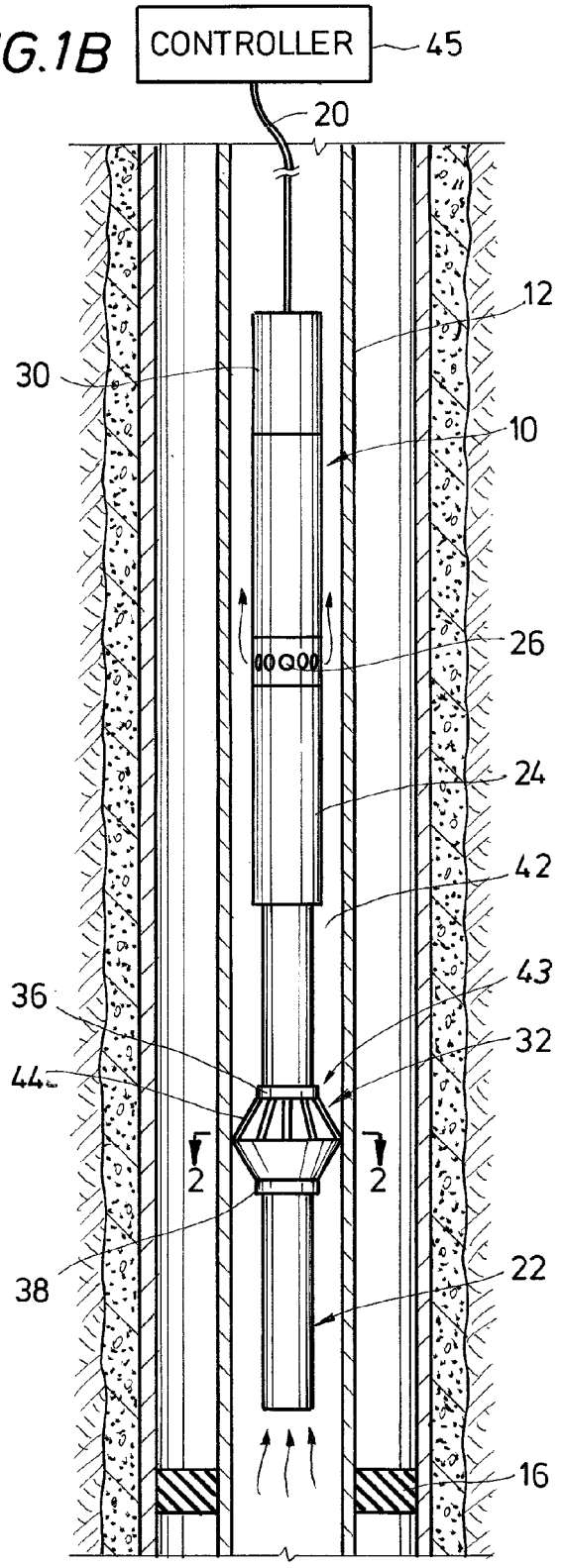
FIG. 1B is a side partial sectional view of the example of FIG. 1A showing the seal in a deployed position and in accordance with the present invention.

Referring now to FIG. 1B, the isolation device 32 is shown in a deployed configuration wherein the upper end of the barrier 34 has expanded radially outward and into sealing contact with the inner surface of the tubing 12. The radial expansion of the barrier 34 is caused by the flow of the discharged fluid from the ports 26, into the annular space 42 between the ESP system 10 and tubing 12, and towards the barrier 34. Directing a flow of pressurized fluid from the ports 26 and across the upper end of the barrier 34, separates the upper free end of the barrier 34 from the surface of the ESP system 10 from the stowed configuration of FIG. 1A into the open and deployed configuration of FIG. 1B. As shown in FIG. 1B, the upper end of the barrier 34 sealingly contacts against the inner surface of the tubing 12 while the lower bracket 38 retains the lower end of the barrier 34 against the ESP system 10. While in the deployed configuration, the barrier 34 thus defines a pressure barrier within the annulus 42 that separates produced fluid flowing into the pump inlet 22 from the discharged fluid exiting the ports 26. In an example, the isolation device 32 will remain in the deployed configuration as long as the pump 24 remains operational and forces pressurized discharge fluid from the ports 26 so that a pressure differential exists across the barrier 34. Optional support ribs 43 are shown included with the embodiment of the barrier 34 of FIG. 1B, where the ribs 43 are elongate members integral with or attached to the barrier 34 and extend in a general direction from a lower end of the barrier 34 to its upper end. Struts 44 may optionally be included that each pivotingly attach on one end to the upper bracket 36 and pivotingly attach on a distal end to one of the ribs 43. The combination of the ribs 43 and struts 44 provides structural support for the barrier 34, such as for when the barrier 34 is deployed as in FIG. 1B and subjected to a pressure differential. In an example embodiment, deployment of the barrier 34 as illustrated in FIG. 1B occurs automatically with operation of the pump 24.

In an example alternative, operation of the pump 24 can be momentarily suspended while the ESP system 10 is repositioned within the tubing 12 to a different depth. While being repositioned, the barrier 34 can migrate into the stowed configuration of FIG. 1A. Once set at the different depth, operation of the pump 24 may be resumed by powering the motor 30 thereby reverting configuration of the barrier 34 into the deployed position of FIG. 1B from the stowed position of FIG. 1A. An optional controller 45 is shown that can be used for operation of the pump 24 and via connection to the power cable 20. In this configuration, control signals may be made via the power cable and to the pump motor 30. The controller 45 can be disposed at surface or downhole.

Figure 2:
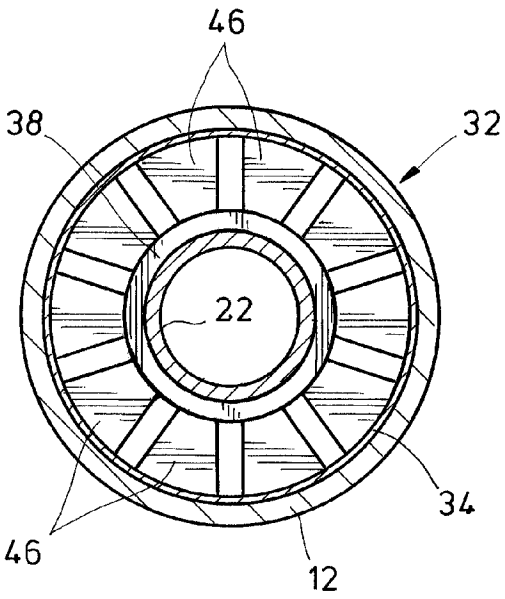
FIG. 2 is an axial partial sectional view of the pumping system of FIG. 1B and taken along lines 2-2.

An axial view of the isolation device 32 is provided in FIG. 2 taken along lines 2-2. As shown in the embodiment of the isolation device 32 of FIG. 2, a series of plates 46 are shown set on an inner surface of barrier 34, where each plate 46 has a trapezoid like configuration. The shorter side of each of the two parallel sides of the trapezoidal like plate 46 is pivotingly anchored adjacent the lower bracket 38. When the barrier 34 is in the deployed position, the upper planar surfaces of each of the plates 46 are slidingly sandwiched against one another. When deployed, as in the example of FIG. 2, the plates 46 may slightly fan out from one another and provide support for the barrier 34 during its sealing function against the wall of the tubing 12. Example materials for the plates 46 include metals, composites, combinations thereof, and the like.

Figure 3A:
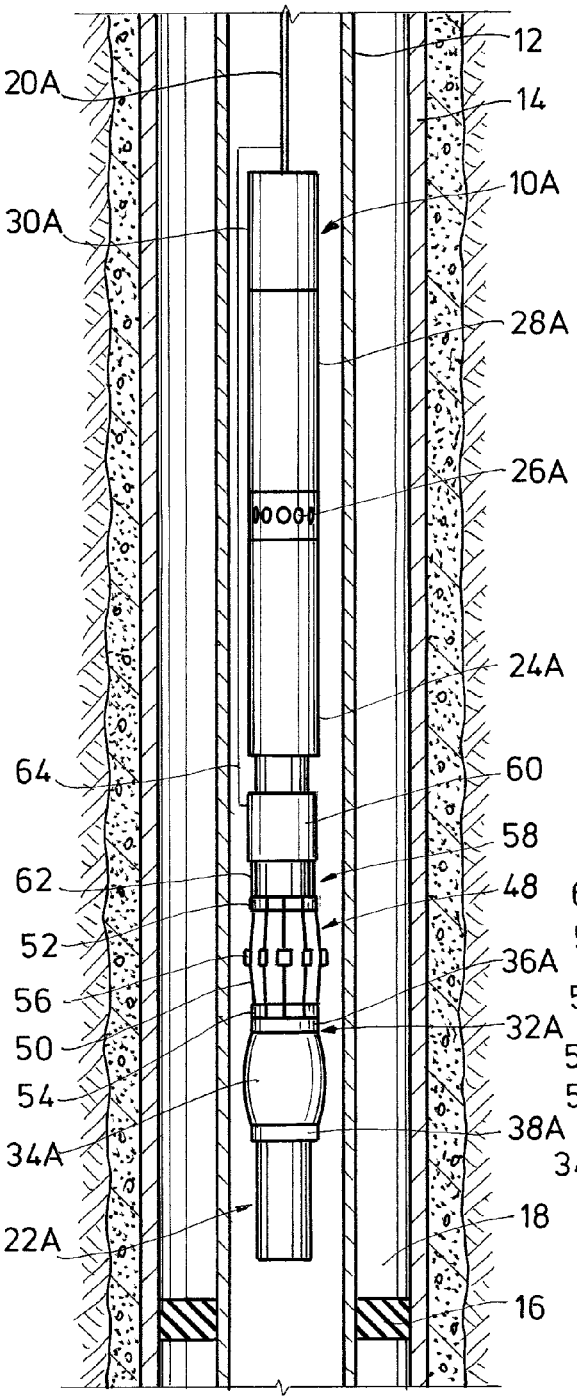
FIG. 3A is a side partial sectional view of an alternate example embodiment of a through tubing pumping system having a seal in a stowed position and in accordance with the present invention.
Figure 3B:
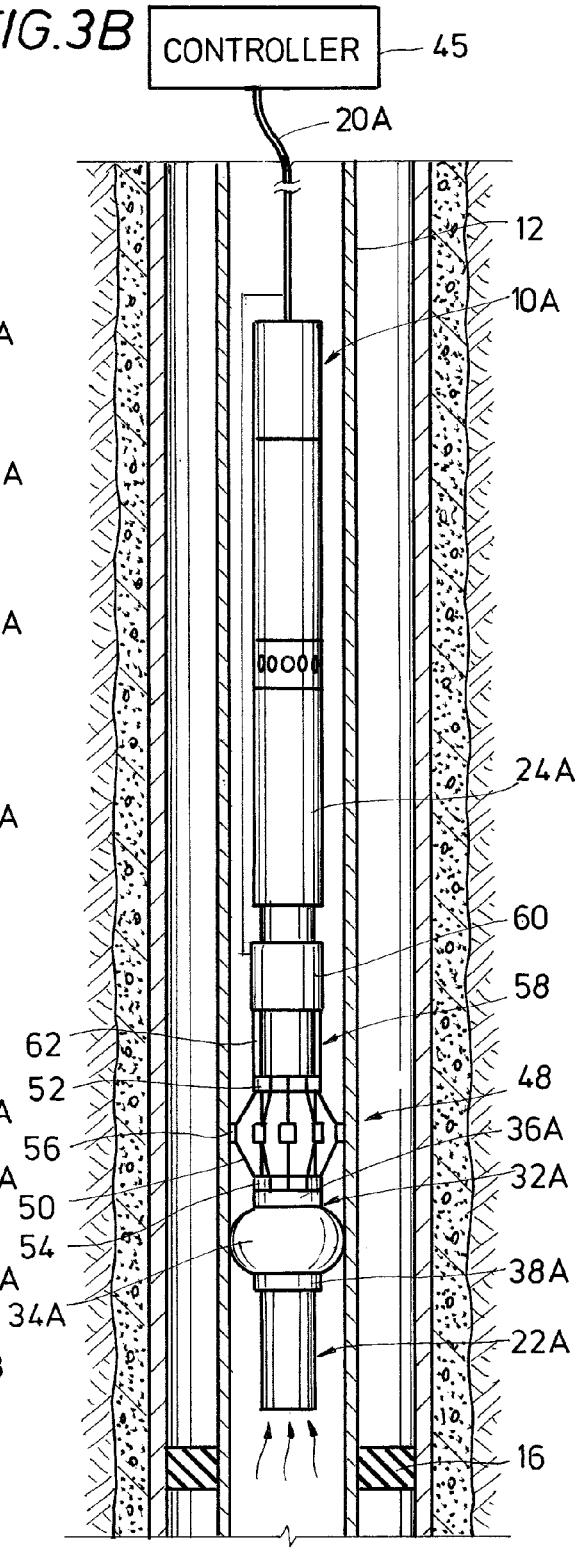
FIG. 3B is a side partial sectional view of the example of FIG. 3A showing the seal in a deployed position and in accordance with the present invention.

FIGS. 3A and 3B illustrate in side partial sectional view operation of an alternate example of an ESP system 10A. In the example of FIG. 3A, the ESP system 10A includes an annular pump inlet 22A connected onto the lower end of the pump 24A and ports 26A that define a discharge for the pump 24A. The equalizing seal 28A and motor 30A are also shown as part of the ESP system 10A of FIG. 3A, which in an example are similar to the respective seal 28 and motor 30 of FIG. 1A. The ESP 10A of FIG. 3A also includes an isolation device 32A having a barrier 34A that resembles a bladder like membrane. The lower end of the barrier 34A is sealingly mounted to the outer surface of the pump inlet 22A by lower bracket 38A. Upper bracket 36A secures upper end of the barrier 34A around an axial portion of the pump inlet 22A. Further included with the ESP assembly 10A of FIG. 3A is an anchor 48 that circumscribes the pump inlet 22A at a location just above upper bracket 36A. The anchor 48 includes a series of linkage members 50 having one of their ends pivotingly mounted into an upper collar 52. The upper collar 52 of FIG. 3A defines an upper end of the anchor 48. Another series of linkage members 50 each have an end pivotingly mounted into a lower collar 54 shown coaxially adjacent with upper bracket 36A and below upper collar 52. Ends of linkage members 50 respectively distal from the upper and lower collars 52, 54 extend towards one another and couple within landing pads 56 shown within the mid portion of the anchor 48 and between the upper and lower collars 52, 54. Optionally, each linkage member 50 may have one end within the upper collar 52 and its opposite end set within the lower collar 54; so that along their respective mid-portions, each of the linkage members 50 intersect a landing pad 56.

An example of an actuator 58 is illustrated set above the anchor 48 and is provided for actuating the anchor to retain the ESP system 10A within the tubing 12. The example actuator 58 as shown includes a base 60 with arms 62 that depend axially downward and into contact with the upper collar 52 of the anchor 48. In one example, the base 60 is an annular member that couples on an outer surface of the pump inlet 22A and provides a support for the arms 62 to exert an axial force onto the upper collar 52. Control and power may be provided to the actuator 58 via a line 64 that connects to the power cable 20A. Optionally, a battery (not shown) can be included with the ESP system 10A for powering the system alone or in combination with power delivered via the power line 20A.

Referring now to FIG. 3B, illustrated in side sectional view is an example of operation of anchoring the ESP system 10A. In this example the arms 62 of the actuator 58 extend away from the base 60 and urge the upper collar 52 downward along the outer surface of the pump inlet 22 towards the lower collar 54. The pivoting attachment of the linkage members 50 with the upper collar 52 and lower collar 54 causes the landing pads 56 to project radially outward and into contact with the inner surface of the tubing 12. In an example, the landing pads 56 exert a force onto the tubing 12 sufficient to prevent rotation of the ESP assembly 10A within the tubing 12. When engaged, the anchor 48 can also prevent the ESP assembly 10A from moving axially within the tubing 12. The actuator 58 may be electrically or hydraulically powered. Control and/or power of the actuator 58 can be done via the power cable 20A. It is within the capabilities of those skilled in the art to develop and implement an actuator for use with the ESP system.

Figure 4:
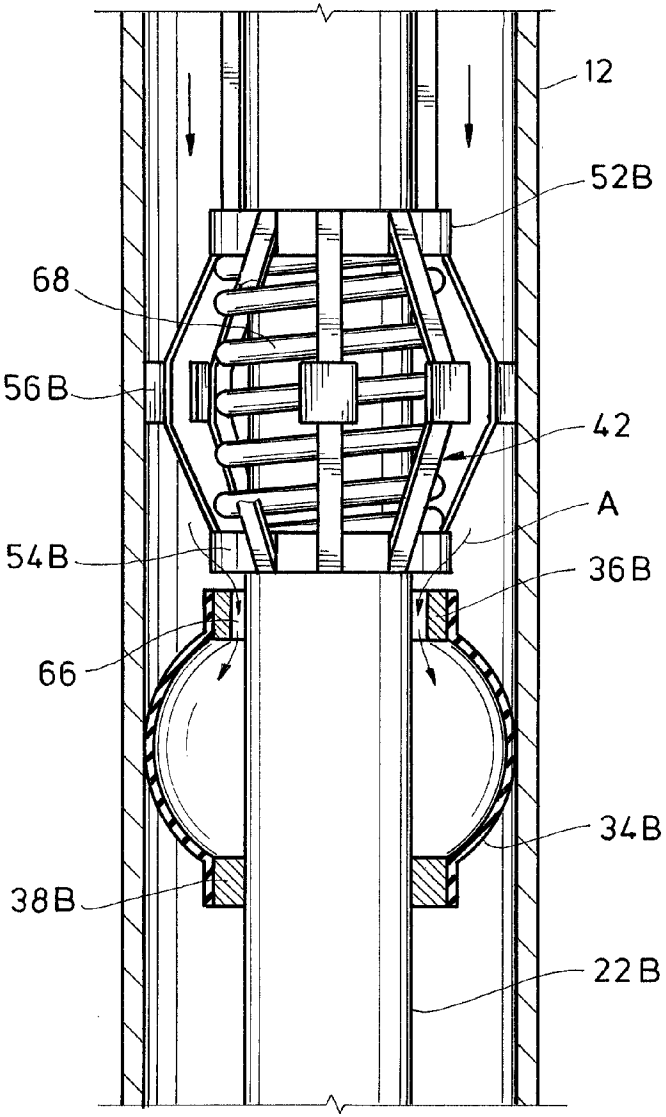
FIG. 4 is a side partial sectional detailed view of the seal and anchor portion of the pumping system of FIG. 3B in accordance with the present invention.

Further shown in FIG.3B is the barrier 34 in a deployed mode with its outer surface in sealing contact with the inner surface of the tubing 12. Because the barrier 34 extends radially outward from the pump inlet 22A and fills the space between the inlet 22A and tubing 12, a pressure barrier is formed. In this example, the pressure barrier isolates discharged fluid flowing from ports 26 from produced fluid flowing into the pump inlet 22A. Au example of expanding the barrier 34A into its deployed configuration is shown in side partial sectional view In FIG. 4 where illustrated in detail is an example embodiment of the anchoring and isolation portions of the ESP assembly 10A of FIG.3B. As depicted in the example of FIG. 4, the upper end of the barrier 34B is secured to the upper bracket 36B, and the upper bracket 36B is spaced radially outward from the pump inlet 22B and axially away from lower bracket 38B.Spacing the upper bracket 36B radially outward defines a gap 66 between the upper bracket 36B and pump inlet 22B similar to the barrier 34 of Figures lA and 1B. In an example, barrier 34B fills with discharged fluid from the pump 24A (FIG. 3B), as illustrated by arrows A making their way through the gap 66. As such, pressure isolation can he achieved between the inlet and discharge of the pump 24A while it is operational. Optionally, barrier 34A can he made from a substantially solid elastomerie member that expands radially outward when axially compressed. Metal plates (not shown) may be included with barrier 34A in one example embodiment where the plates can overlap to improve sealing. A portion of the plates can extrude outside the elastomer and engage the tubular, which can provide an anti-rotation force. In an alternate embodiment, a timer (not shown) is included with the ESP system 10A for use in control of the system 10A, embodiments include the timer being in communication with the controller 45.

Further illustrated in FIG. 4 is a spring 68 coiled around the pump inlet 22B and between the upper and lower collars 52B, 54B. When the anchor 48B is in the anchoring configuration of FIG. 4, the spring 68 is in a compressed state, so that by retracting the actuator 58 upward and away from the upper collar 52B, the compressed spring 68 can axially bias the upper collar 52B away from the lower collar 54B thereby drawing the landing pads 56B radially inward and away from the tubing 12. This unanchors the pumping assembly from within the tubing 12 and enables withdrawal of the ESP system 10A, or redeployment of the ESP system 10A at a different depth within the tubing 12. In one optional embodiment, the lower collar 54B is in selective contact with the upper bracket 36B, so that when anchor 48B is deployed, the upper bracket 36B is urged downward causing the barrier 34A to radially expand similar to a packer and create the sealing barrier.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, a locking mechanism can be included to lock the isolation device in place. Also, shear pins may optionally be included to allow unsetting of the isolation device when being pulled. These and other similar modifications will readily suggest themselves to those skilled in the art, and are intended to be encompassed within the spirit of the present invention disclosed herein and the scope of the appended claims.

What is claimed is:

1. A downhole assembly for use in production tubing comprising:

an outer surface;

a power cable a pump having a pump inlet and a pump discharge;

a motor for driving the pump and that is powered by electricity delivered through the power cable;

a membrane barrier that defines a seal between the pump inlet and pump discharge and that comprises, a lower end distal from the pump discharge, and an upper end between the lower end and the pump discharge that is selectively changeable from a stowed configuration adjacent the outer surface to a deployed configuration radially spaced away from the outer surface and adjacent an inner surface of the production tubing, and which defines an opening facing the pump discharge, so that when fluid flows from the pump discharge, the discharged fluid enters the opening and fills an annular space between the outer surface and production tubing and blocks discharged fluid from entering the pump inlet; and an actuator coupled with the outer surface, that is powered by electricity in the power cable, and that is selectively extended into contact with the upper end and which urges the membrane barrier into the deployed configuration.

2. The downhole assembly or claim 1, wherein the lower end of the barrier is damned around the outer surface.

3. The downhole assembly of claim 1, wherein a lower end of the barrier distal from the pump discharge is clamped around the Outer surface, an upper end of the member proximate the pump discharge is secured to the outer surface with a gap between the upper end and the outer surface that defines the opening, wherein a middle portion of the barrier flares ridially outward into contact with the tubing when the actuator is urged against the open end.

4. The downhole assembly of claim 1, further comprising an anchoring system mounted onto the outer surface that includes a plurality of anchoring legs that each have a portion that selectively projects radially outward into contact with an inner surface of the tubing.

5. The downhole assembly of claim 4, wherein the actuator selectively biases against ends of the anchoring legs for projecting the anchoring legs radially outward.

6. The downhole assembly of claim 1, wherein the membrane barrier comprises an annular bladder and wherein the seal comprises a lower bracket that sealingly couples around the outer surface and art upper bracket that circumscribes the outer surface and is set radially outward from the outer surface, and wherein an upper end of the bladder mounts to the upper bracket and a lower end of the bladder mounts to the lower bracket.

7. The downhole assembly of claim 1, wherein the membrane barrier has a lower end that pivotingly mounts to the outer surface and an upper end with an outer periphery that defines the opening, and folds in the membrane barrier between the lower end and upper end.

8. The downhole assembly of claim 7. further comprising rib supports extending along a path between lower and upper ends of the barrier and coupled with the burner, and struts that each have an end pivotingly mounted to an upper bracket that circumscribes the outer surface and a distal end pivotingly coupled to a one of the rib supports.

9. A wellbore assembly insertable in a tubular disposed in a wellbore comprising;

a power cable;

a pump connected to an end of the power cable and selectively operable from electricity in the power cable, the pump having a discharge and an annular inlet that depends axially from an end of the pump;

a seal assembly circumscribing the annular inlet comprising, a lower bracket sealingly mounted to an outer surface of the annular inlet, and a membrane having, a lower end coupled to the lower backet, an upper end spaced axially away from the lower end, and an outer periphery between the upper and lower ends that selectively projects from a position adjacent an outer surface of the annular inlet and radially outward into sealing contact with an inner surface of the tubular to define a sealing configuration; and an actuator powered by electricity in the power cable that selectively imparts a force onto the upper end to urge upper end towards the lower end and cause the outer periphery to bulge radially outward and to block fluid communication between the discharge and an entrance to the inlet along an annulus circumscribing the annular inlet.

10. The wellbore assembly of claim 9, further comprising an upper bracket circumscribing the annular inlet an axial distance from the lower bracket, wherein an upper end of the membrane is coupled to the upper bracket.

11. The wellbore assembly of claim 10, wherein the upper bracket is spaced radially outward from the annular inlet.

12. The wellbore assembly of claim 9, further comprising an anchoring system comprising elongated linkage members disposed at circumferential positions around the annular inlet, upper ends mounted in an upper collar, and lower ends mounted in a lower collar.

13. The wellbore assembly of claim 12, wherein the actuator selectively biases the upper collar towards the lower collar and causing the mid portions of the linkage members to extend radially outward from the annular inlet and into engagement with an inner surface of the tubular.

14. The wellbore assembly of claim 12, wherein the actuator comprises an annular base circumscribing the inlet and spaced axially away from the seal assembly and arms that are selectively extendable away from the base, and wherein the seal assembly comprises an upper bracket connected to an upper end of the membrane and that circumscribes the inlet and has an inner diameter greater than an outer diameter of the inlet to define an opening, so that when the arms project into urging contact with the upper collar, the lower collar is urged against the upper bracket to axially motivate the upper bracket towards the lower bracket to thereby configure the membrane into the sealing configuration.

15. The wellbore assembly of claim 9, wherein the membrane has a lower end that pivotingly mounts to an outer surface of the annular inlet and an upper end with an outer periphery that defines an opening, folds in the membrane between the lower end and upper end, rib supports extending along a path between lower and upper ends of the membrane and coupled with the membrane, and struts that each have an end pivotingly mounted to an upper bracket that circumscribes the outer surface and a distal end pivotingly coupled to a one of the rib supports.

16. A method et pumping fluid from a wellbore comprising:

providing a wellbore assembly comprising a pump having an inlet and a discharge, a seal assembly basing a membrane with a lower end sealed against an outer surface of the wellbore assembly and an upper end spaced radially outward from the outer surface to define an opening, and an actuator in selective contact with the upper end;

disposing: the wellbore assembly in a tubular in the wellbore and on and end of a power cable;

forming a seal between the wellbore assembly and the tubular by powering the actuator with electricity in the power cable and directing the actuator to axially urge the upper end towards the lower end thereby radially expanding a mid-portion of the membrane radially outward into sealing contact with an inner surface of the tubular.

17. The method of claim 16, further comprising, pressurizing fluid produced from the wellbore with the pump and flowing the pressurized fluid from the discharge to the opening to further radially expand the membrane into sealing engagement with the tubular, and suspending the step of pressurizing fluid so the membrane radially retracts from the tubular, moving the wellbore assembly to a different depth in the wellbore, and repeating the step of forming a seal.

18. The method of claim 16, wherein the seal isolates fluid produced from the wellbore from fluid being discharged from the pump.

19. The method of claim 16, wherein the wellbore assembly further comprises an anchoring system having linkage members with ends that respectively connect to axially spaced apart collars that circumscribe the inlet, and wherein the anchoring system is disposed between the actuator and the seal assembly, so that when the actuator is operated, middle portions of the linkage members project radially outward into anchoring contact with the inner surface of the tubular.

20. The method of claim 19, wherein the actuator comprises a base, and arms that selectively extend axially away from the base into engaging contact with the anchoring system, that in turn axially contacts the seal assembly to urge the upper end towards the lower end.

* * * * *

UNITED STATES PATENT AND TRADEMARK OFFICE

CERTIFICATE OF CORRECTION

PATENT NO. : 9,085,970 B2
APPLICATION NO. : 13/621924
DATED : July 21, 2015
INVENTOR(S) : Jinjiang Xiao and Abubaker Saeed It is certified that error appears in the above-identified patent and that said Letters Patent is hereby corrected as shown below:

On the Title Page, Item (30), the Foreign Application Priority Data appears as "PCT/US2012/05527" and should read --PCT/US2012/055270--.

In the Claims
In Column 8, Line 4, Claim 2, the fourth word appears as "or" and should read --of--.

In Column 8, Line 5, Claim 2, the sixth word appears as "damned" and should read --clamped--.

In Column 8, Line 8, Claim 3, the third word appears as "Outer" and should read --outer--.

In Column 8, Line 12, Claim 3, the first word appears as "ridially" and should read --radially--.

In Column 8, Line 25, Claim 6, the fifth word appears as "art" and should read --an--.

In Column 8, Line 37, Claim 8, the ninth word appears as "burner" and should read --barrier--.

In Column 9, Line 39, Claim 16, the third word appears as "et" and should read --of--.

In Column 10, Line 2, Claim 16, the second to last word appears as "basing" and should read --having--.

In Column 10, Line 7, Claim 16, the first word appears as "disposing:" and should read --disposing--.

Signed and Sealed this
Twenty-ninth Day of December, 2015

Michelle K. Lee

Michelle K. Lee
*Director of the United States Patent and Trademark Office*